United States Patent [19]

Zahn

[11] 4,077,752

[45] Mar. 7, 1978

[54] APPARATUS FOR TAKE-UP AND STORAGE OF THREAD BUNDLES

[75] Inventor: Willy Zahn, Heusenstamm, Germany

[73] Assignee: Zimmer Aktiengesellschaft, Germany

[21] Appl. No.: 656,342

[22] Filed: Feb. 9, 1976

[30] Foreign Application Priority Data

Feb. 10, 1975 Germany ..... 2505547

[51] Int. Cl.[2] ..... D01D 7/00; D01D 13/00

[52] U.S. Cl. ..... 425/72 S; 28/290; 242/42; 242/47; 242/35.5 R

[58] Field of Search ..... 425/72 S; 242/35.5 R, 242/42, 47; 28/21

[56] References Cited

U.S. PATENT DOCUMENTS

| | | | |
|---|---|---|---|
| 2,145,290 | 1/1939 | Bower | 425/72 S X |
| 3,720,382 | 3/1973 | Lehner | 425/72 S X |
| 3,902,833 | 9/1975 | Matovinovic | 425/72 S X |

FOREIGN PATENT DOCUMENTS

| | | | |
|---|---|---|---|
| 35,603 | 3/1969 | Japan | 28/21 |

*Primary Examiner*—Robert D. Baldwin
*Attorney, Agent, or Firm*—Allegretti, Newitt, Witcoff & McAndrews

[57] ABSTRACT

A flexible apparatus and method for producing synthetic fibers in either the form of a single thread bundle on a bobbin, or as a combined thread strand in a storage can, without rearranging the spinning plant. This is accomplished by extruding the threads, one bundle from each of a series of aligned spinnerets, downwardly through ducts carrying a stream of air, and mounting directly beneath the ducts, in alignment therewith, an elongated take-up machine. The take-up machine has a row of winding devices on one side and a row of combining rollers on the other. The thread bundle from each spinneret is directed through a duct arrangement either to one side or the other of the take-up machine. All spinnerets may feed one side, or the other, or the production can be mixed with some spinnerets feeding one side and some the other, depending upon whether the market demand is for filament yarns or staple fibers.

8 Claims, 8 Drawing Figures

APPARATUS FOR TAKE-UP AND STORAGE OF THREAD BUNDLES

BACKGROUND OF THE INVENTION

The invention relates to apparatus for the take-up and the storage of thread bundles, produced from high-polymer spinning materials. The threads emerge from a serial arrangement of spinnerets, are solidified by an air blast and drawn off continuously downwards, one bundle from each spinneret. The kind of storage depends upon the reprocessing of the thread bundles to the desired intermediate or end product. If filament yarn is to be produced from the thread bundles, the thread bundle extruded from each spinneret is usually drawn off by means of an arrangement of godets mounted on the take-up machine, moistened and/or treated with a liquid finish and wound up for storage. Starting from the bobbin, the thread bundle is then stretched and, for yarn production, possibly textured and drawtextured.

If, however, the thread bundles are to be reprocessed to staple fibers or fiber yarn, it is customary to draw off first the single thread bundles separately and to apply a finish. After the take-up on the take-up machine, the direction of the bundles is changed from vertical to horizontal and they are combined with correspondingly treated fiber bundles to provide a thread strand which is drawn off laterally by rollers and deposited for storage in a can. Then, the thread strands are continuously drawn off upwards from a plurality of filled cans and combined to a thread tow which is stretched, crimped, dried and possibly heat-set. The two may be intermediately deposited in containers or cut direct to staple fibers which generally are pressed subsequently to bales from which, finally, the fiber yarn is spun.

For the two process operations described above in principle differently designed units and combinations of units, i.e., production plants are employed, according to the present art. They include, as a rule, not only the spinning units, to which the high-polymer melt (coming direct from the polymerization stage or from molten chips by means of an extruder) is fed, but also blow ducts, spinning ducts and finally the special take-up machines having specific devices for storage depending on the end product. The storage devices may then be followed by reprocessing units.

These specialized process operations require that a complete production plant be shut down every time there is no market demand for the one or the other product, i.e., for filament yarn or fiber yarn. And the market demand is exceedingly difficult to predict for certain man-made spinning materials, for instance, polyamide yarns for carpet manufacture.

SUMMARY OF THE INVENTION

The object of the present invention is to provide a process and an apparatus for its performance which permit flexibility in meeting specific production requirements in filament yarns or fiber yarns, using essentially the same equipment.

This object is achieved starting from the process previously mentioned by taking-up the thread bundles as single bundles per spinneret on bobbins, and/or by depositing them as a combined thread strand from a plurality of spinnerets in cans.

According to the basic concept of the invention, the thread bundles are taken up from the same spinning unit, possibly after a simple spinneret exchange, and passed to the appropriate storage. It is possible (a) to deposit the thread bundles of all spinnerets in the form of a thread strand for staple fiber and fiber yarn production in cans, or (b) to take up the thread bundles from all spinnerets for filament yarn production on bobbins, or (c) to combine the thread bundles partially to a thread strand and to take them up partially on bobbins. This results in a remarkable adaptability of the production plant to market requirements.

The fibers in the thread bundles to be taken up and stored on bobbins may be oriented to a higher or lower degree with respect to the position of the macromolecules in the single fiber capillaries, depending upon the take-up speed rate. The thread bundles may also be completely oriented by providing a preliminary stretching between rollers. Also, it is possible first to stretch and then to texture the thread bundles before winding them on bobbins. Another possibility is to wind one or several thread bundles per spinning position, on one or several winding spindles. Finally, the thread bundles from each spinning position (spinneret) may be deposited in small cans.

The apparatus of the invention comprises spinnerets aligned in one or several parallel rows, blow ducts arranged in a row below the spinnerets, and, connected to the blow ducts, spinning ducts which end just above an elongated take-up machine aligned and centered with respect to the row of spinnerets. The apparatus is characterized in that the take-up machine is equipped, on the one side, with a row of winding devices and, on the other side, with a row of two combining rollers, and is mounted approximately with its longitudinal center line below the center of the spinning line, and the spinning ducts are designed to follow the thread path to both sides of the take-up machine.

A feature of the apparatus according to the invention is the double-sided design of the take-up machine, its one side being designed for the take-up and the storage of thread on bobbins and its other side for the take-up and storage in the can piler. Either side may be operated separately or jointly with the other depending upon the desired intermediate or end product. If it is intended to wind on bobbins and to deliver into cans at the same time, the quantitative proportions are variable by regulating the distribution of the thread bundles to the respective sides of the take-up machine.

The term 'spinning line' is defined as the imaginary connecting line between the centers of the blow duct outlet openings or the equivalent imaginary connecting line between the centers of the spinnerets.

Since the thread bundles, as they are drawn off to the one or the other side of the take-up machine, are diverted laterally from the vertical, the design of the spinning duct must take into account the variable thread path. For this purpose, it is proposed in one embodiment of the apparatus that the side walls of the spinning ducts diverge outwardly towards the lower end, thus corresponding to the split thread path. Also, that the lower ends of the spinning ducts, except for two lateral passage openings for the thread bundles, be closed by end plates. This spinning duct is broad enough to cover both branches of the thread path.

To facilitate handling the threads during the start-up procedure for spinning, it is advisable to provide flaps, slide valves or the like, in the end plates for enlarging the passage openings.

If the thread bundles all pass to the one side of the take-up machine, it is advantageous in this embodiment to avoid a large central dead space which might cause thread disturbing effects during start of spinning and during operation. This is accomplished by providing at the lower end of each spinning duct a hinged flap covering the width of the duct and projecting upwards into the duct. The flap may be rested against the one or the other of the diverging side walls to control the flow of air.

In a further embodiment of the apparatus, it is proposed that the spinning ducts at their lower ends split into branch pipes in an inverted Y configuration. With this arrangement, the upper part of the spinning duct is common to both thread path directions whereas, in the lower part, a pipe leg is provided for each of the two thread paths.

With this embodiment, too, it is advantageous to provide a hinged flap at the branch covering the duct width and projecting upwards into the spinning duct, which may rest against the one or the other of the side walls of the upper part of the spinning duct to block air flow.

In a further embodiment of the invention, each of the spinning ducts are hinged to the lower end of the corresponding blow duct as a swing pipe. In this embodiment, the thread path within each spinning duct may lead only to the one or the other side of the take-up machine. In the prior embodiments, however, the thread path may lead simultaneously to both sides of the take-up machine.

The deflection required for the diversion of the threads out of the vertical path may be provided thread guides disposed in the thread path between the spinnerets and the take-up machine. Suitably, these thread guides are arranged at the lower end of the blow duct. It is feasible to do without thread guides providing the air flow conditions in the blow duct are selected so that the thread adopts a free course without any contact occurring with the walls of the blow duct or the spinning duct.

DESCRIPTION OF THE DRAWINGS

The invention is described in detail hereunder with the aid of the schematic drawings illustrating the embodiment examples of the apparatus according to the invention, in which.

DETAILED DESCRIPTION

Figure 1:
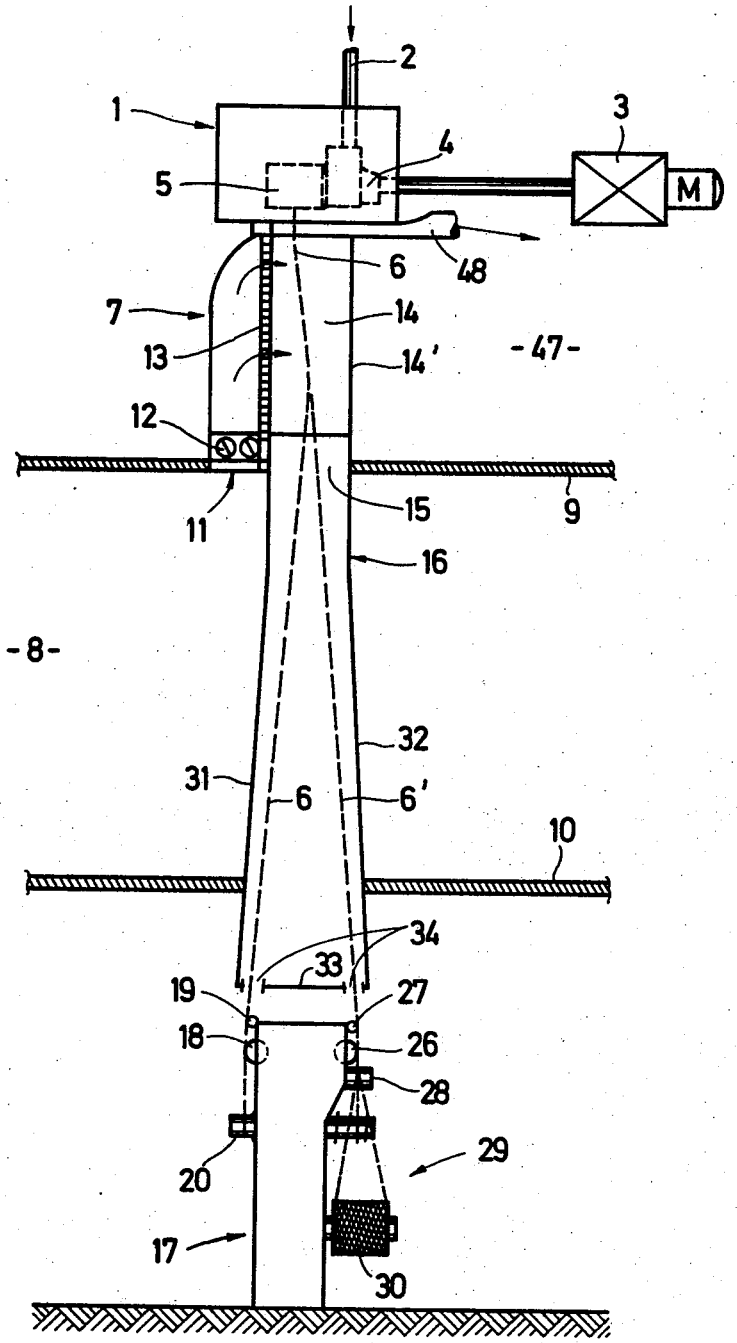
FIG. 1 is a vertical section through a spinning plant, showing one spinning unit.

In the upper half of FIG. 1, one spinning position of a series of multiposition spinning manifolds 1 is shown. The high-polymer melt coming either from the end reactor of a polymerization and polycondensation plant or from a melting extruder, is passed through the tube 2 to the spinning manifold and distributed through pipelines (not shown) to the individual spinning positions. In each spinning position a spinning pump 4, positively connected to a drive 3, conveys the melt to a spinneret block 5 from which the spinning melt emerges downwards through one or several spinnerets (not shown) in the shape of a plurality of single threads. The spinnerets are aligned in a row, each producing a bundle of threads. The course of the thread bundles, the so-called thread path 6, is marked in FIG. 1 by broken lines and in the FIGS. 4 through 8 by dash-dotted lines. In their descent, the threads are exposed to conditioned air blowing across the path 6 of the threads, and thereby causing them more rapidly to solidify and cool. The air blast is fed to the blow duct 7 from a pressure chamber 8, which is limited at the top and the bottom by floor ceilings 9 and 10, respectively, passing through opening 11 under volume control 12. The air enters the thread area 14 of the blow duct 7 through directing vanes 13 and leaves the duct, after passing through the thread bundle, by a door 14' from where it flows as exhaust air into the spinning room 47. The reference number 48 designates a suction unit for vapours accumulating during the spinning procedure. The threads are shifted, owing to the air blast and depending on the blast intensity, to a greater or lesser extent out of their vertical line of fall. The degree of displacement depends, apart from the blast intensity, upon the tractive force with which the threads are drawn off downwards. Since these factors are maintained as constant as possible, the thread bundle rests so to speak on an air cushion. The shape, which the thread bundle assumes in the longitudinal direction, depends substantially upon the distribution of intensity of the air blast, referred to as the air blast profile. The conditions are chosen in practice so that the threads leave the lower end of blow duct opening 15 (also the beginning of the spinning duct 16) approximately at its center.

The spinning ducts 16 for each spinneret pass through the floor ceiling 10 and end above the elongated take-up machine designated, in general, by 17. The position of the thread paths 6 and 6' in the spinning duct depends upon to which of the two sides of the take-up machine 17 the threads are drawn off. In the example according to FIG. 1 the devices for the take-up and the storage in the form of the can piler are on the left side, opposed to the direction of blast, whereas the devices for the take-up and the storage on bobbins are arranged on the right side of the take-up machine, in the direction of blast. This arrangement, however, is not imperative and may be just as well reversed providing the take-up machine 17 is aligned with and centered with respect to the spinnerets in the spinning line.

Figure 2:
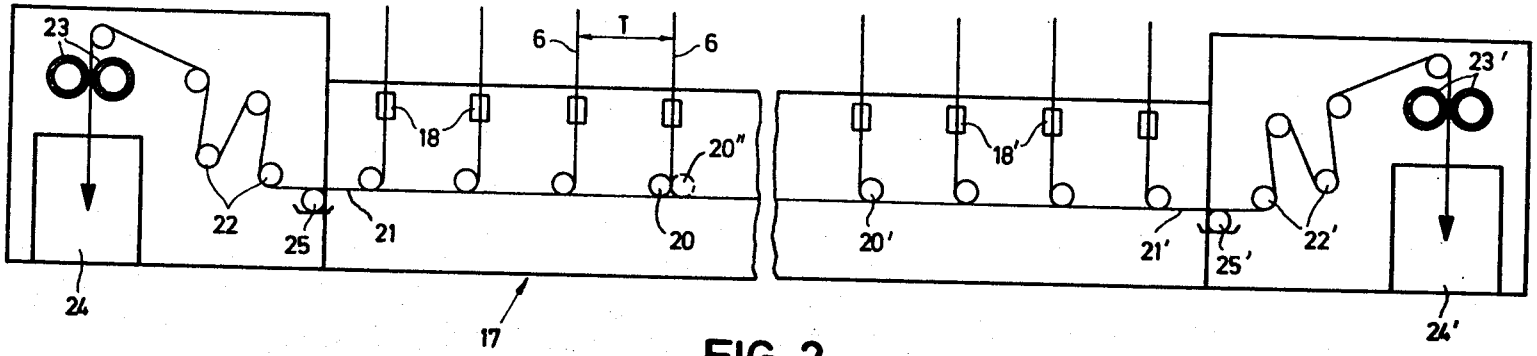
FIG. 2 is a side view, partially broken away, of the can piler side of the take-up machine.
Figure 3:
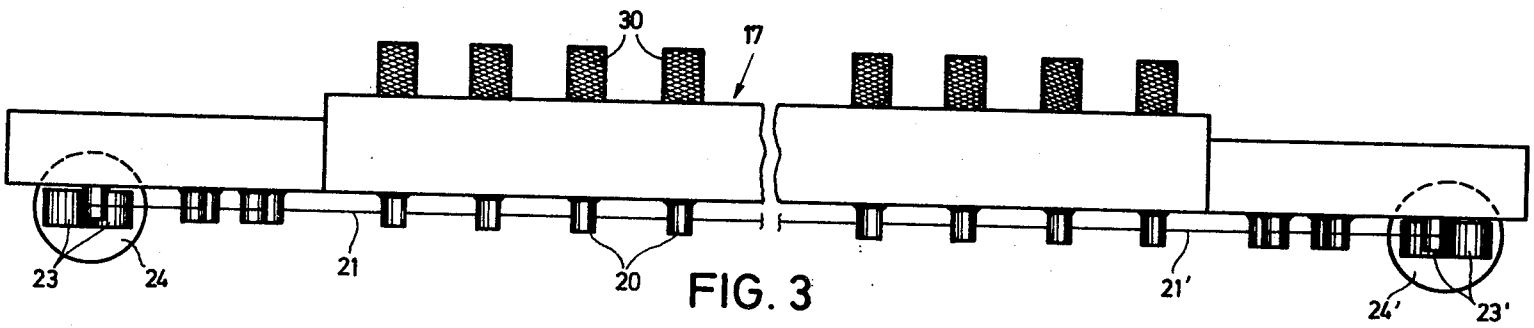
FIG. 3 is a plan view of the machine shown in FIG. 2, with can storage on one side and bobbin storage on the other.

To illustrate the devices for producing thread strands and a thread tow, respectively, reference is made to the left lower half of FIG. 1 in connection with FIGS. 2 and 3. The devices for producing thread strands include a roll 18 for finishing the thread bundle, a preceding diverting thread guide 19, and combining rollers 20 serving to change the direction of the thread bundles and to combine them to a thread strand 21. Instead of the combining rollers 20, stationary or rotating pins or a row of pins may also be provided. The thread strand 21 is then drawn off by the roller frame 22, passed to a pair of reels 23 and delivered by the latter into the can 24 (FIG. 2). An additional finish may be applied by means of a roller 25 prior to depositing the thread strand.

The drawing-off from, and the depositing in cans may take place, as shown in FIGS. 2 and 3, in two directions, in which case two thread strands 21 and 21' are formed. The arrangement is mirror-symmetrical, as illustrated in FIGS. 2 and 3. The dimension T shown on FIG. 2 between two neighboring thread paths 6 is the gauge of the spinning section and indicates the distance between the single spinning positions, the blow ducts and the spinning ducts, as well as the corresponding devices on the take-up machine 17. The number of the spinning positions which are allotted to one can piler, may be definitely prefixed, that is, divided in halves or unequally, but it may also be variable in that the total of the combining rollers 20 and 20' may be variable with respect to their position and direction of rotation so that they divert the thread strand into the opposite direction to the position 20'' marked in FIG. 2 by broken lines. The same applies analogously to other means of diverting and combination not illustrated in the figures, but mentioned above.

The devices for the winding of the thread bundles include rolls 26 for the moistening and oiling of the thread bundles, (which rolls may be preceded by diverting thread guides 27) and one or several draw-off godets 28, as well as winding devices, marked in general by the reference number 29, by means of which the thread bundles are cross-wound into bobbins 30. Such winding devices may comprise a winding spindle driven directly by motor power or indirectly through friction pulley. It is also possible to provide several winding devices for each spinning position. Each winding device may wind up one or several thread bundles. The thread bundles may also be drawn off directly by the bobbins themselves. In this case, no draw-off godets need be provided.

The production from the spinneret block 5 may be distributed so that the total capacity is directed to one side of the take-up machine 17 to produce thread strands or alternately to the other side to produce bobbins. Or the spinning material produced may be provided and a portion passed to the one side of the take-up machine 17 for making thread strands and another portion to the other side for making bobbins. In this way, high flexibility of the plant is ensured.

As shown in FIG. 1, the alternative guidance of the thread bundles to the right or left side of the take-up machine 17 is achieved with the help of a common spinning duct 16, the side walls 31 and 32 of which diverge from each other towards the lower end to provide thread-path straddling. The lower end of the spinning duct 16 is partially closed by the end plate 33 leaving passage openings 34 on either side for the thread bundles.

Flaps or slide valves (not shown) may be installed in the end plate 33 to enlarge openings 34 at the beginning of the spinning operation.

The bringing-down of the thread end during starting of spinning is achieved, as a rule, through gravity. The starting of spinning may be facilitated by providing a down current of air in the spinning duct 16. This is very easily achieved providing the spinning room 47 has a higher static pressure than the take-up room, i.e., the room in which the take-up machine 17 is set up. Hence air flows from the spinning room and blast air from the thread area 14 of the blow duct 7 through the spinning duct 16 and emerges from the passage openings 34. During the stringing-up of the threads, the flaps or slide valves in plate 33 are closed so that only the passage openings 34 remain, with a cross section large enough for the passage of the thread bundles. During this operation exchange of large volumes of air between the mentioned rooms of different static pressures is undesirable.

The spinning duct 16 shown in FIG. 1 has a comparatively large central dead space between the thread paths 6 and 6' which also may have disturbing effects during starting of spinning, and during operation. The embodiments shown in FIGS. 4 through 8 avoid the formation of a larger central dead space.

Figure 4:
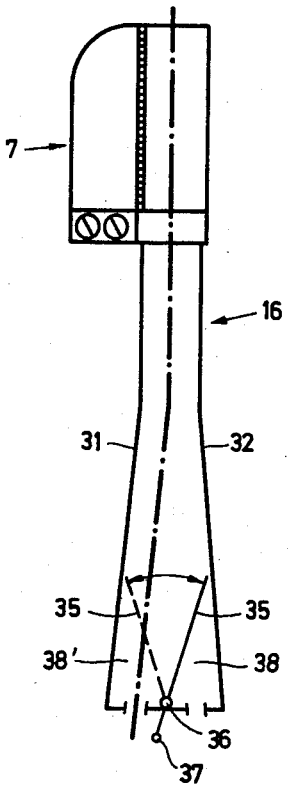
FIGS. 4 through 6 are sectional views of embodiments of the spinning duct differing from FIG. 1, and FIGS. 7 and 8 show the arrangement of thread guides at the lower end of the blow duct shown in profile.

In the spinning duct 16 shown in FIG. 4 at the lower end, the flap 35, covering the duct width and projecting upwards, is hinged at 36. The actuation of the flap 35 is easily effected from the take-up room with the help of a lever 37. Depending on its position the flap 35 shuts off the dead spaces 38 or 38' and thereby facilitates the starting of spinning by preventing disturbing air turbulences.

Figure 5:
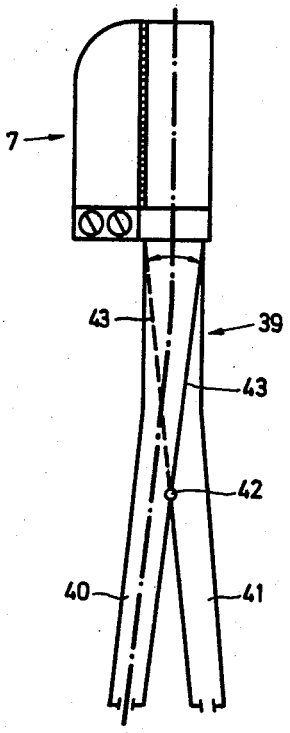

The same effect is achieved by the embodiment shown in FIG. 5. In this case, the spinning duct 39 branches at its lower end into pipes 40 and 41 to form an inverted Y configuration fork, a flap 43 projecting upwards is hinged at 42. The flap 43 in this embodiment is suitably actuated (not shown) from the spinning room.

Figure 6:
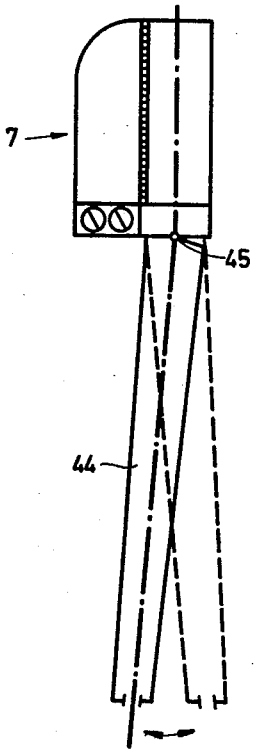
Figure 7:
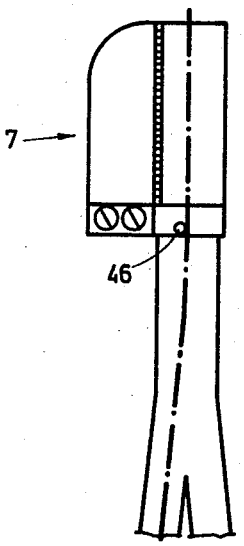
Figure 8:
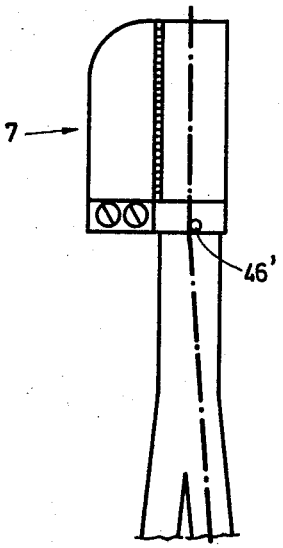

Finally, the spinning duct may consist, as shown in FIG. 6, of a single comparatively narrow swing pipe which is hinged at 45, at the lower end of the blow duct 7. With this moving embodiment, care must be taken that a tight seal of the spinning duct is achieved where it passes through the floor-ceilings.

The thread path between spinneret and take-up machine may be stabilized by interposed thread guides. In the examples of embodiments shown in FIGS. 7 and 8, the thread guides 46 and 46', respectively are arranged at the lower end of the blow duct 7, directly before the diverting of the thread bundle to the one or the other thread path in the spinning duct. Depending upon whether thread path is led to the one or the other side of the take-up machine 17, the thread guide is mounted on the one or the other side of the thread path as it is evident from the FIGS. 7 and 8. The thread guide 46, 46' may be constructed in different ways. By way of example, it may be made from metal, glass, ceramic and other material. It may also be used for moistening and finishing of the thread bundles by making it hollow and providing outlet openings for liquid. In the embodiment shown, it consists of a smooth bar. For the spinning of several thread bundles it may be composed of several sections to form a slotted thread guide.

It is to be understood that the embodiment of the invention which has been described is merely illustrative of one application of the principles of the invention. Numerous modifications may be made to the disclosed embodiment without departing from the true spirit and scope of the invention.

I claim:

1. Apparatus for taking up and storing thread bundles produced from high polymer spinning materials comprising a series of spinnerets aligned in a row with each spinneret adapted to extrude a bundle of threads in a downward direction, a blow duct connected to the discharge end of each spinneret, a spinning duct connected to the lower end of each blow duct, and an elongated take up machine disposed beneath the lower ends of said spinning ducts, said machine being aligned with and centered with respect to said row of spinnerets, wherein said take-up machine includes along its length on one side a row of winding devices and along its length on the other side a row of thread-combining rollers, each of said spinning ducts including means arranged to direct the thread path to either side of said take-up machine.

2. Apparatus of claim 1 wherein at least one of said spinning ducts has side walls that diverge toward the take-up machine to accommodate thread bundles directed to one or the other sides of said take-up machine, and an end plate closing the end of the spinning duct except for two lateral openings for passage of the thread bundles.

3. Apparatus of claim 2 in which a hinged flap is disposed within said duct movable to block one or the other of said lateral openings.

4. Apparatus of claim 1 in which at least one of said spinning ducts branches at its lower end into separate pipes to form an inverted Y configuration, one pipe leading to said one side and the other pipe to said other side of said take-up machine.

5. Apparatus of claim 4 in which a hinged flap is disposed in said duct at the inverted Y, movable to block one or the other of said pipes.

6. Apparatus of claim 1 in which at least one of said spinning ducts is hinged where it is connected to said blow duct, thereby permitting the discharge end thereof to be moved to said one side or said other side of the take-up machine.

7. Apparatus of claim 1 which includes thread guides within said ducts to control the direction of the thread bundles therethrough.

8. Apparatus of claim 7 in which said thread guide is mounted at the lower end of said blow duct.

* * * * *